US007077122B2

(12) United States Patent
Lyons et al.

(10) Patent No.: US 7,077,122 B2
(45) Date of Patent: Jul. 18, 2006

(54) REDUCED CLEARANCE GAS FIREPLACE

(75) Inventors: David Charles Lyons, Red Wing, MN (US); Richard Berg, Lakeville, MN (US); Scott Stephen Jeutter, Richfield, MN (US); Kurt Matthew Schwie, Savage, MN (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/718,053

(22) Filed: Nov. 19, 2003

(65) Prior Publication Data

US 2005/0103324 A1 May 19, 2005

(51) Int. Cl.
*F24B 1/195* (2006.01)

(52) U.S. Cl. ..... 126/500; 126/544

(58) Field of Classification Search ..... 126/512, 126/500, 85 B, 544, 545; 52/36.3; 40/428; 431/125, 126

See application file for complete search history.

(56) References Cited

U.S. PATENT DOCUMENTS 4,726,351 A * 2/1988 Whittaker et al. ..... 126/512
4,913,131 A * 4/1990 Petersen ..... 126/544
5,471,973 A * 12/1995 Wilhoite ..... 126/200
5,542,407 A * 8/1996 Hawkinson ..... 126/77
5,613,487 A * 3/1997 Hawkinson ..... 126/512
5,626,127 A 5/1997 Maitland et al.
5,782,231 A * 7/1998 Wade ..... 126/512
5,996,575 A * 12/1999 Shimek et al. ..... 126/512
6,138,667 A * 10/2000 Cakebread ..... 126/512
6,170,481 B1 * 1/2001 Lyons et al. ..... 126/512
6,378,516 B1 * 4/2002 Blount ..... 126/512
6,385,881 B1 5/2002 Hess
2003/0019490 A1 * 1/2003 Buffington ..... 126/500
2003/0049575 A1 3/2003 Lyons et al.
2004/0149279 A1 8/2004 Erickson
2004/0173202 A1 9/2004 Lyons et al.
2004/0200470 A1 10/2004 Rumens

FOREIGN PATENT DOCUMENTS

FR 2 650 371 A1 * 2/1991

OTHER PUBLICATIONS

Town & Country Fireplaces™ Installation and Operating Instructions for the Series A Direct Vent Fireplace; 28 pages.
Majestic Vermont Castings Installation Instructions and Homeowner's Manual for Chateau™ Direct Vent Decorative Gas Appliance Model: DVT38, DVT44, 37 pages; Jan. 2004, Rev.4.

* cited by examiner

*Primary Examiner*—Josiah C. Cocks
(74) *Attorney, Agent, or Firm*—Faegre & Benson, LLP

(57) ABSTRACT

A fireplace includes an outer enclosure having a front panel defining a front of the fireplace, and a combustion chamber enclosure defining a combustion chamber and including a front surface. The combustion chamber enclosure is positioned within the outer enclosure at a location spaced rearward from the front panel of the outer enclosure. The fireplace includes a glass panel secured to the front surface of the combustion chamber enclosure, and a surround member adapted and configured to be positioned between the front panel of the outer enclosure and the glass panel to cover the glass frame from view. Controls for the fireplace are positioned between the outer enclosure and the combustion chamber enclosure.

22 Claims, 6 Drawing Sheets

REDUCED CLEARANCE GAS FIREPLACE

CROSS REFERENCE TO RELATED APPLICATIONS

The present application claims priority to U.S. Design patent application Ser. No. 29/194,205, entitled "Portion of Facade for a Heating Unit", filed on the same date herewith, which application is incorporated herein by reference in its entirety.

FIELD OF THE INVENTION

The present invention generally relates to fireplaces, and more specifically relates to fireplaces that meet reduced clearance conditions.

BACKGROUND OF THE INVENTION

It is common for most fireplaces to have a relatively small viewing area as compared to the fireplace frame that is exposed to a view. For example, many fireplaces include a glass panel or doors through which the internal cavity (or combustion chamber) is viewed, as well as vents and louvers above and below the glass and exposed framing around several sides of the glass. As a result, only about 30 to 50% of the total front surface area of the fireplace is glass or otherwise provides viewing of the combustion chamber. Because the non-glass features of the fireplace front cover such a large percentage of the fireplace front surface, the combustion chamber itself must often be significantly reduced in size in order for the fireplace to be sized for a given fireplace application.

One primary reason why the glass portion of a fireplace front surface is restricted in size is because of the clearance required below the combustion chamber to house the fireplace controls. Typically, a fireplace includes controls for the heat source, such as a valve for a gas burner or a thermostat for electric heat source, and those controls are positioned beneath the combustion chamber with access to that space being provided by a removable panel or an access cover positioned below the fireplace glass.

Another reason why the glass portion of a fireplace front surface is restricted in size is to provide space for a blower and air plenum system that are typically at least partially positioned beneath the combustion chamber. Typically, cool room air is drawn into the plenum by the blowers through a vent/louver at a bottom portion of the fireplace front, the air is heated within the plenum from heat emanating from the combustion chamber, and the heated air is exhausted out from the plenum with the blower through a vent/louver at a top portion of the fireplace front. The plenum and associated vents/louvers require space and framing that may otherwise be available for the combustion chamber and the fireplace glass.

A further disadvantage of many known fireplaces is that the airflow into the combustion chamber for purposes of combustion is often restricted. Due to the space requirements of the plenum system and controls, the passages used for directing combustion air into the combustion chamber are relatively small and natural movement of air through these passages may be difficult. Restricted flow of combustion air often results in a diminished flame size and sometimes less efficient combustion of the fuel.

A fireplace that addresses these and other disadvantages of known fireplaces would be an important advance in this technical field.

SUMMARY OF THE INVENTION

The present invention generally relates to fireplaces, and more specifically relates to fireplaces that meet reduced clearance conditions. One aspect of the invention relates to a fireplace that includes a combustion chamber enclosure defining a combustion chamber, and an outer enclosure having a front panel and defining an inner volume sized to receive the combustion chamber enclosure at a position spaced rearward of the front panel. An access panel of the fireplace is positioned between the combustion chamber enclosure and the front panel of the outer enclosure, and fireplace controls are disposed within the inner volume of the outer enclosure outside of the combustion chamber enclosure.

Another aspect of the invention relates to a fireplace that includes a combustion chamber enclosure having top, bottom, rear, and first and second side panels that define a combustion chamber. The combustion chamber enclosure panels define a front surface and a combustion chamber. The combustion air enclosure includes top, bottom, rear and first and second side panels, and the combustion air enclosure panels are generally aligned with and spaced apart from an outside surface of respective panels of the combustion chamber enclosure thereby defining a combustion air chamber between the combustion chamber enclosure and the combustion air enclosure.

A further aspect of the invention relates to a method of manufacturing a fireplace that includes an outer enclosure having a rear panel and a front panel that defines a front surface of the fireplace. A combustion chamber enclosure of the fireplace includes at least a front surface and a side surface thereby defining a combustion chamber. The fireplace also includes a combustion air passage wrap, a glass panel, and controls. The method includes positioning the combustion chamber enclosure within the outer enclosure between the front and rear panels such that the front surface of the combustion chamber enclosure is spaced rearward from the front panel, securing the glass panel to the front surface of the combustion chamber enclosure, positioning the controls between the outer enclosure and the combustion chamber enclosure, for example between a side surface of the combustion chamber enclosure and he outer enclosure, and positioning the air passage wrap between the outer enclosure and the combustion chamber enclosure thereby forming a combustion air passage between the air passage wrap and the combustion chamber enclosure.

Another aspect of the invention relates to a method of assembling a fireplace that includes a combustion chamber enclosure defining a combustion chamber, a combustion air enclosure, and a glass panel. The method includes positioning the combustion chamber enclosure within the combustion air enclosure and securing the glass panel to the combustion chamber enclosure with the combustion air enclosure positioned there between, thereby sealing the fireplace with an air-tight seal.

A still further aspect of the invention relates to a fireplace that includes an outer enclosure having a front panel defining a front of the fireplace, and a combustion chamber enclosure that defines a combustion chamber and includes a front surface. The combustion chamber enclosure is positioned within the outer enclosure at a location spaced rearward from the front panel of the outer enclosure. The fireplace also includes a glass panel that includes a glass frame and a glass sheet mounted in the glass frame. The glass panel is secured to the front surface of the combustion chamber enclosure. The fireplace further includes a surround member positioned between the front panel of the outer enclosure and the glass panel to cover the glass frame from view.

The above summary of the present invention is not intended to describe each disclosed embodiment or every implementation of the present invention. Figures in the detailed description that follow more particularly exemplified embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments in the invention and in connection with accompanying drawings, in which.

Figure 1:
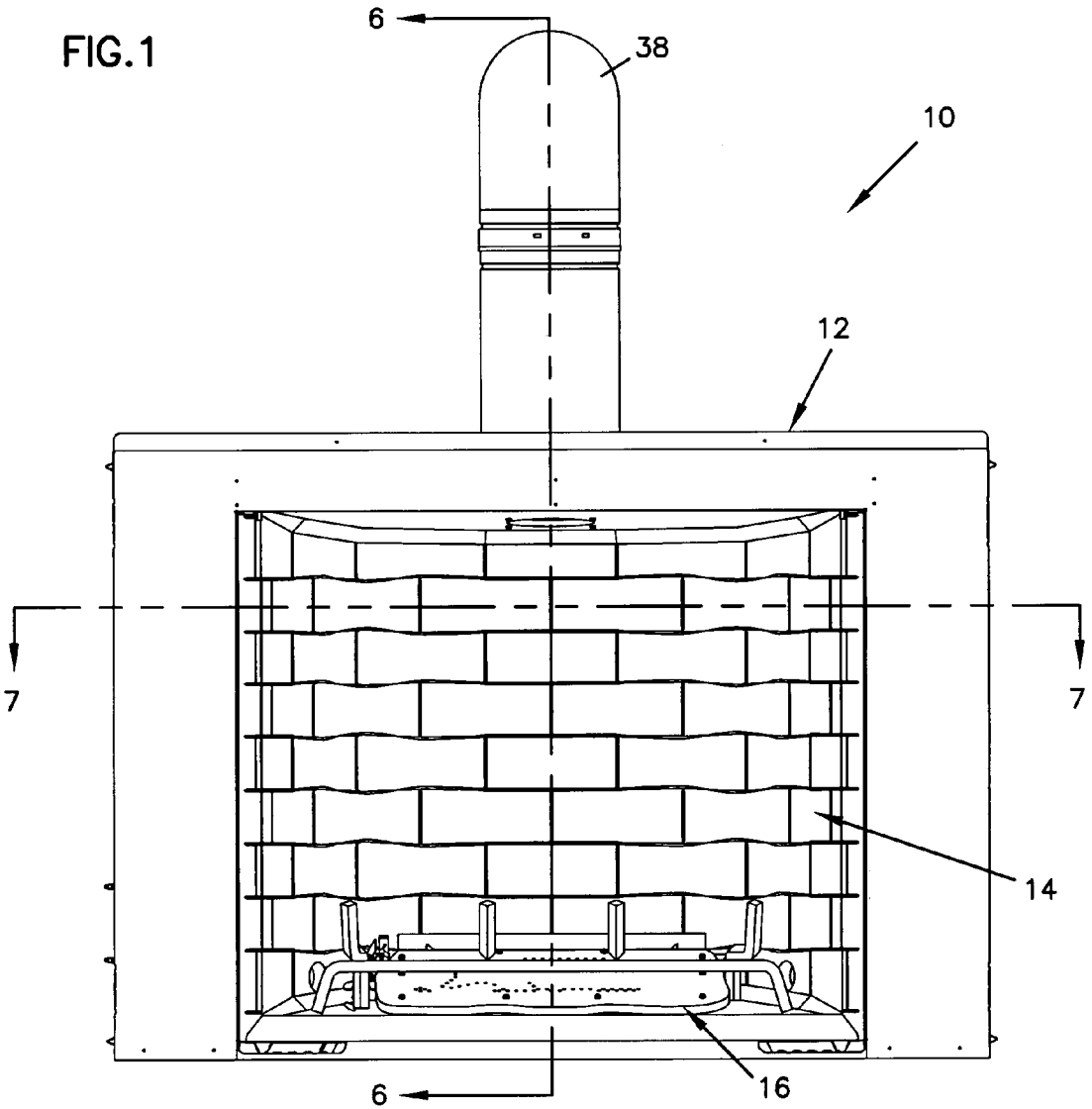
FIG. 1 is a front plan view of one example fireplace according to principles of the present invention.

While the invention is amenable to various modifications and alternate forms, specifics thereof have been shown by way of example in the drawings and will be described in detail. It should be understood, however, that the invention is not limited to the particular embodiments described. On the contrary, the invention is to cover all modifications, equivalents, and alternatives falling within the spirit and scope of the invention.

DETAILED DESCRIPTION OF THE PREFERRED EMBODIMENT

The present invention generally relates to fireplaces, and more particularly relates to fireplaces with a reduced clearance requirement. The present invention also relates to methods of forming a fireplace combustion chamber enclosure from a molded material such that the enclosure includes a brick design. The present invention further relates to a fireplace having controls that are positioned between the outer enclosure of the fireplace and the combustion chamber enclosure. The present invention yet further relates to sealing the combustion chamber enclosure and combustion air passage at the front surface of the combustion chamber enclosure in a single sealing step.

The fireplace examples disclosed and illustrated herein are gas burning fireplaces, but may be an electric or other types of fireplace that generate heat. While the example embodiments of the present invention provided below are described in conjunction with example fireplaces, the present invention may be applicable to other systems or apparatuses such as furnaces and stoves. Some example fireplaces that may be used in accordance with the present invention include a direct vent, a universal vent, a B-vent, a horizontal/vertical-vent, a dual direct vent, and a multisided unit having two or three glass panels as combustion chamber side panels. While the present invention is not so limited, an appreciation of various aspects of the invention will be gained through a discussion of the examples provided below.

As used herein, a "combustion chamber" may include any structure that at least partially encloses a space in which a flame is generated from combusting material, solid or gas, simulating a flame, or otherwise producing heat. A "combustion air enclosure" is defined as any enclosure that defines a chamber for holding combustion air for use in the combustion chamber.

Figure 2:
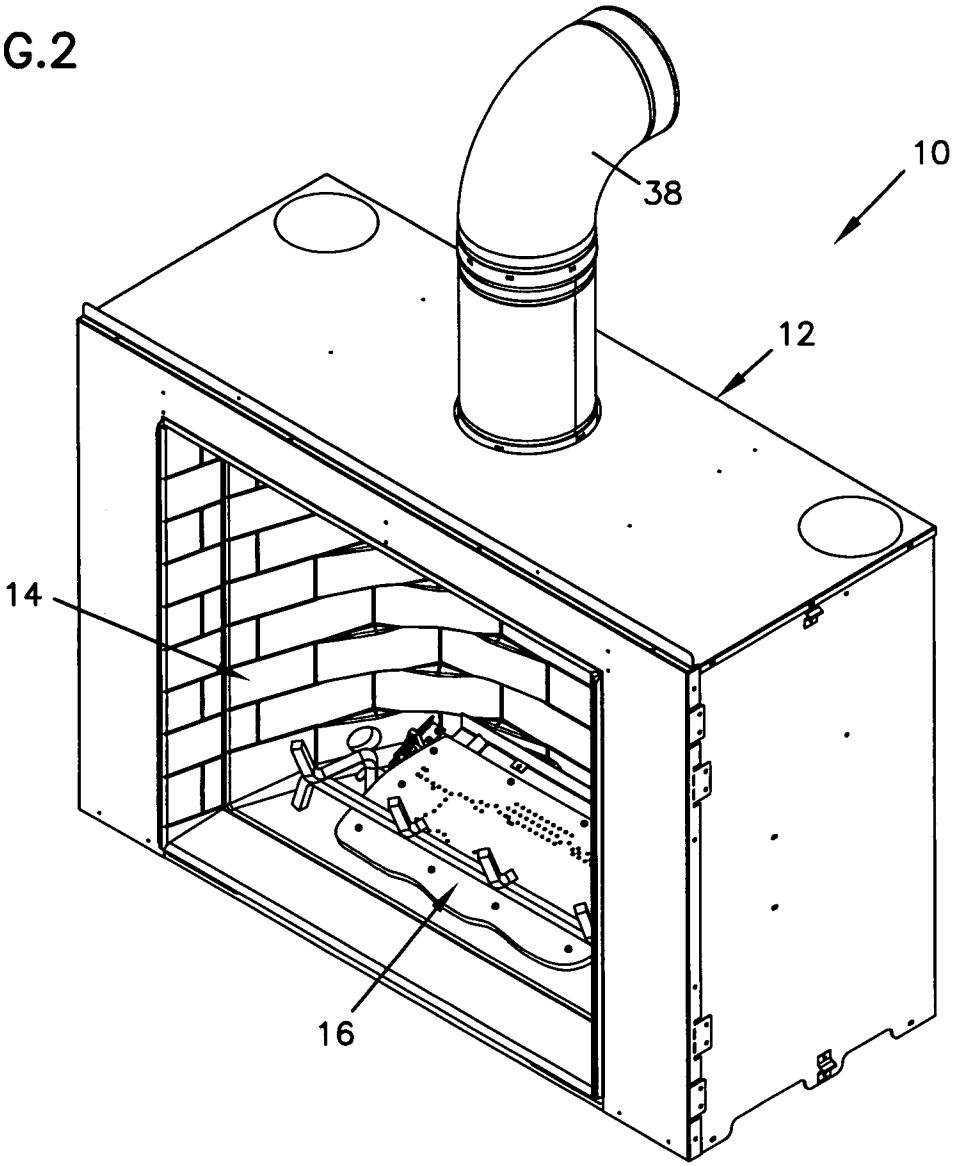
FIG. 2 a front perspective view of the fireplace shown in FIG. 1.
Figure 3:
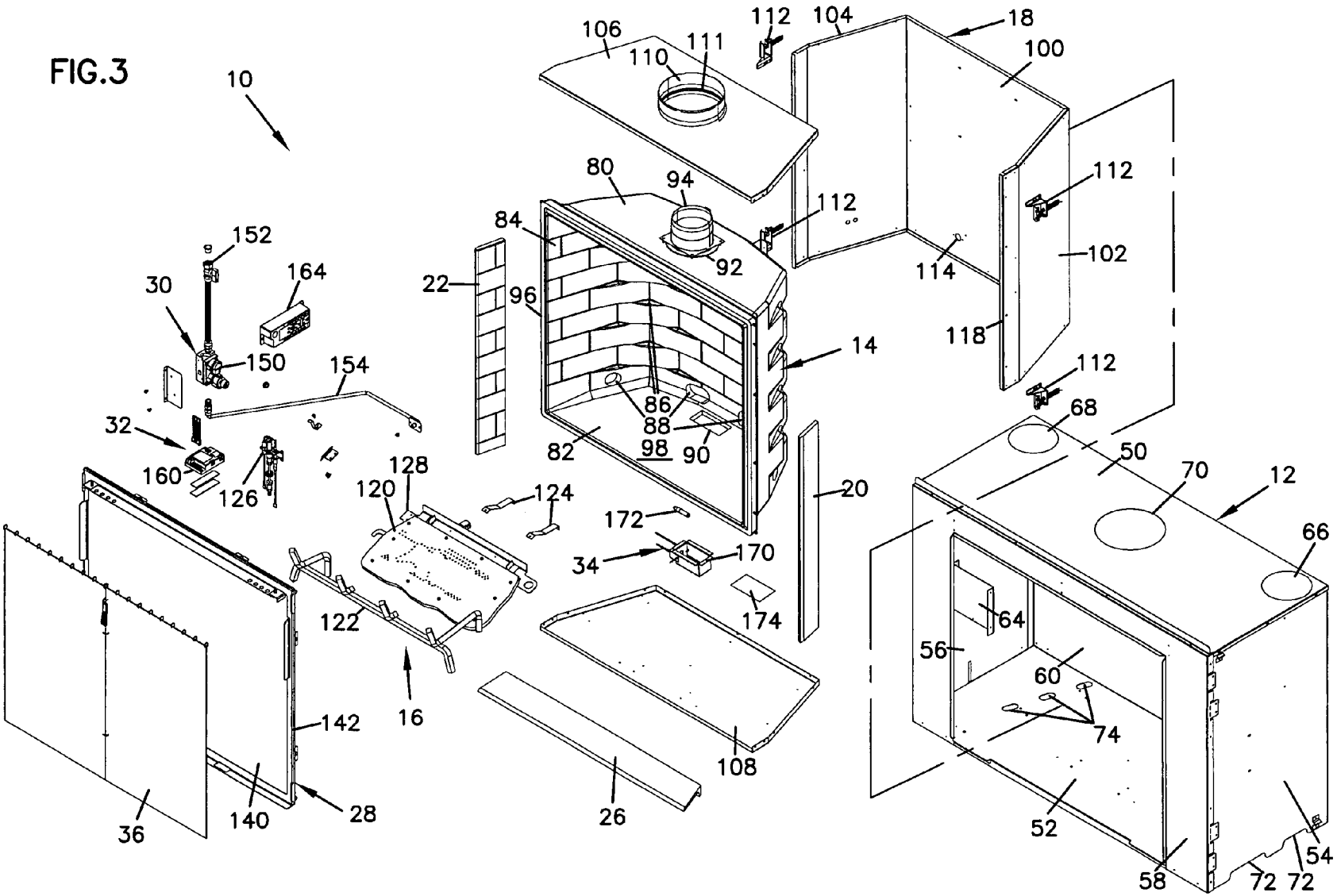
FIG. 3 is an exploded front perspective view of the fireplace shown in FIG. 1.

One example fireplace assembly 10 that includes features of the present invention is described and illustrated with reference to FIGS. 1-8. Referring first to FIGS. 1 and 2, fireplace assembly 10 includes an outer enclosure 12, a combustion chamber enclosure 14, a burner plate assembly 16 and a direct vent duct 38. Fireplace assembly 10 includes a large viewing area and the bottom surface of the combustion chamber enclosure 14 has little clearance underneath it so as to be substantially flush with a bottom surface of the outer enclosure 12. In fact, the space shown underneath the bottom panel of the combustion chamber enclosure 14 is raised slightly so that it is substantially flush with the hearth that is typically built up just in front of the fireplace assembly when mounted in a structure such as a home. It may be further noticed that fireplace assembly 10 does not give the appearance of having a framed piece of glass covering the fireplace opening because no glass frame is visible. These and other advantages of the present invention will be described in further detail below.

Referring now to FIGS. 3–7, fireplace assembly 10 further includes a combustion air enclosure 18, removable panels 20, 22, 26, a glass panel 28, a gas valve assembly 30, a control unit assembly 32, a light assembly 34, and a hanging wire mesh 36.

Outer enclosure 12 includes a plurality of panels secured together to form a box-like structure sized to receive and/or mount the features listed above. The panels of outer enclosure 12 include a top panel 50, a bottom panel 52, first and second side panels 54, 56, a front panel 58 and a rear panel 60. These panels may be secured together by any of a variety of methods including, for example, welding, using fasteners, or formed using such techniques as bending or stamping several panels from a single piece of material. Outer enclosure 12 may also include convection air outlets 66, 68 that allow air that has been heated within the outer enclosure to exit out from the outer enclosure 12, for example, using a pump or fan and then directing the heated air to and air space to be heated or to a furnace ducting system.

Outer enclosure 12 also includes a vent outlet 70 for receiving the exhaust duct 38 through the top panel 50. The side and rear panels 54, 56, 60 may include air escapes 72 around a bottom edge of the panel and bottom panel 52 may include air escapes 74 into the space within the outer enclosure 12 adjacent to the firebox 40 to facilitate air flow out from under the bottom panel 52 to reduce heat buildup underneath the outer enclosure 12.

The front panel 58 is preferably configured for mounting a decorative covering such as, for example, a fireplace surround, brick, stone, or tile, after the fireplace assembly 10 is installed.

Outer enclosure 12 may also include combustion air enclosure supports 62, 64 secured to the first and second side panels 54, 56. The supports 62, 64 may be coupled to side panels (discussed below) of the combustion air enclosure 18 to stabilize the firebox 40 (See FIG. 8 described below) during transport and use of fireplace assembly 10. Supports 62, 64 may be supplemented with additional supports (not shown) and may be positioned at different locations within outer enclosure 12 to optimize support and stability of firebox 40 within outer enclosure 12.

Combustion chamber enclosure 14 includes a top panel 80, a bottom panel 82, and a continuous side panel 84 that extends around the sides and rear portion of the combustion chamber enclosure 14 forming a vertical back wall thereof. This particular example combustion air enclosure 18 includes a brick design formed in the continuous side panel 84 having the appearance of firebrick with grout lines. The brick design includes a plurality of ledges 86 that are exposed due to the offset nature of the bricks in the transition area between the sidewalls and rear walls of the combustion chamber enclosure 14. This type of brick design eliminates back corners of the combustion chamber enclosure, but is not so rounded as to give the appearance of a semi-circular combustion chamber enclosure. To maintain the appearance of distinct side and rear walls of the combustion chamber enclosure, there is at least one full brick laying flat (not offset) on each of the side walls and rear wall of the continuous side panel 84. In other embodiments, different sized brick and arrangements of the brick may be used to provide a different look and feel within the combustion chamber enclosure. In other examples, different designs may be used, such as, for example, a river rock or a stone design.

The brick design of combustion chamber enclosure 14 may be formed using, for example, a molding process that requires a ceramic material (such as moldable ceramic or a ceramic fiber) with a binder (See U.S. Publication Application No. US-2003-0049575-A1, which is incorporated herein by reference), or a stamping or other forming method for shaping a metal sheet. An advantage of using a molding process is that the various panels of the combustion chamber enclosure 14 may be formed in a single step (for example using an injection, compression or vacuum molding process) and the shape and size of the brick design (or other design within the combustion chamber enclosure) may be formed with accuracy and precision for every product produced from a given mold. Using a steel product that is stamped or otherwise formed with the desired brick design may have the advantage of lower cost and lighter weight as compared to a molded ceramic or other suitable material used in a molding process.

The combustion chamber enclosure 14 may also include a plurality of combustion air inlet openings 88, a light source opening 90, and an exhaust opening 92 to which an exhaust collar 94 may be secured to vent combustion gases out of the combustion chamber enclosure 14. The combustion air inlet openings 88 provide openings between a combustion air chamber 116 (discussed below) defined by the combustion air enclosure 18 and the combustion chamber enclosure 14 to provide combustion air for burning the fuel within the combustion chamber enclosure 14. Light source opening 90 is sized to receive the light assembly 34 and may also provide an air passage for combustion air to enter into the combustion chamber enclosure 14.

The top, bottom, and continuous panels 80, 82, 84 of combustion chamber enclosure 14 define a combustion chamber 98 and a front surface 96 of the combustion chamber enclosure 14 that is sized and configured to mount the glass panel 28 and provide a surface for creating an airtight seal between the glass panel 28, the combustion air enclosure 18, and the combustion chamber enclosure 14.

Combustion air enclosure 18 includes a plurality of panels, which when assembled together and secured to the combustion chamber enclosure 14 provide a combustion air chamber 116. The combustion air enclosure 18 includes a rear panel 100, first and second side panels 102, 104, a top panel 106 and a bottom panel 108. The side and rear panels 100, 102, may be well suited for formation from a single piece of material that is bent or otherwise formed to provide the various panels, although these panels may be separately formed and secured together and later secured to the top and bottom panels 106, 108 with welding, fasteners, or other suitable connection methods.

A combustion air collar 110 defining a combustion air opening 111 may be formed or otherwise secured in the top panel 106 or another panel of the combustion air enclosure 18 so as to provide a source of combustion air into the combustion air chamber 116. In this example embodiment, the fireplace assembly 10 includes a coaxial pipe 38 that facilitates combustion airflow through an outer pipe and exhaust airflow through a center exhaust pipe of the coaxial pipe 38. Other embodiments may include a co-lineal flue arrangement.

Combustion air enclosure 18 may also include a plurality of glass panel latches 112 secured adjacent to a front surface 118, and may further include a burner gas line opening 114 (discussed below) that is sized to receive the burner gas line 154 (discussed below) of the burner plate assembly 16.

Figure 8:
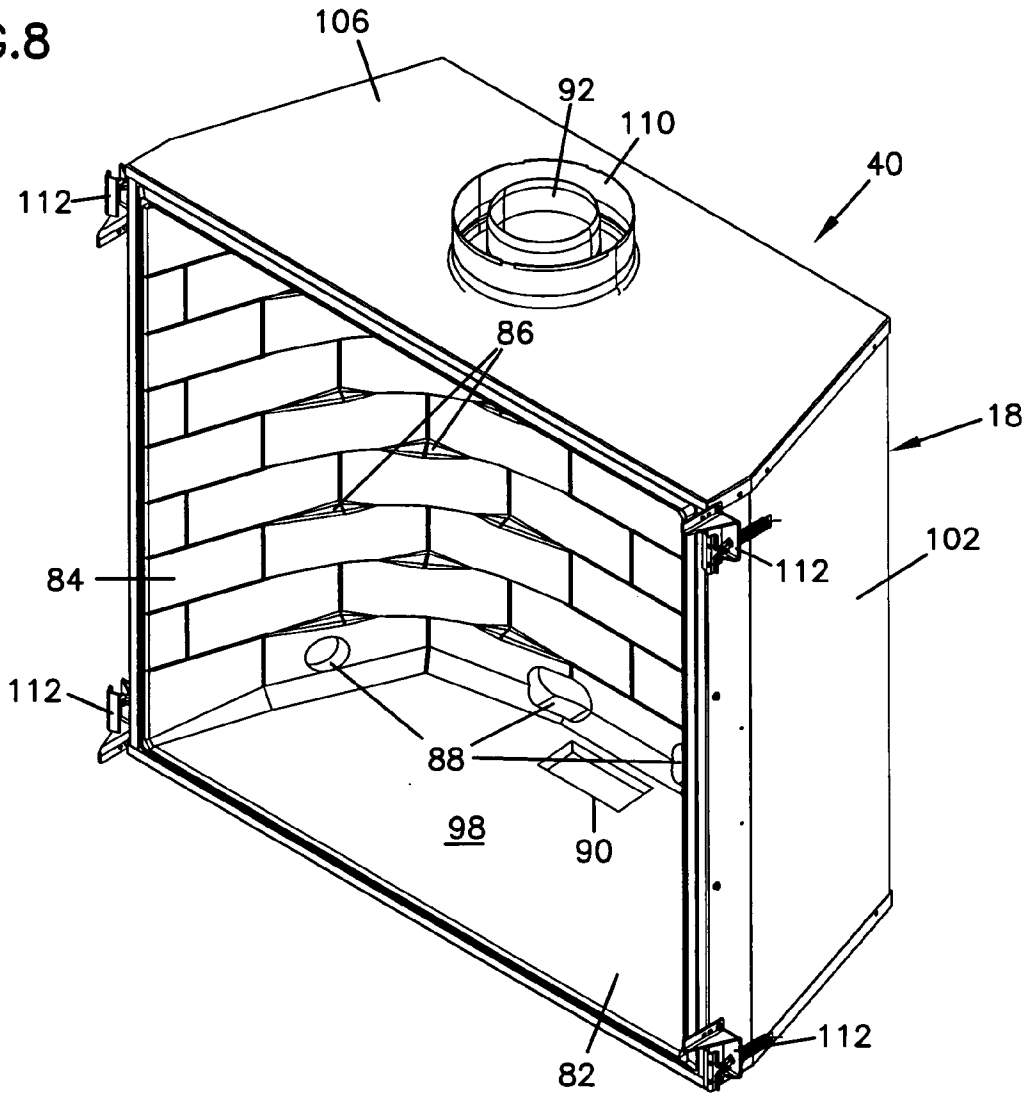
FIG. 8 is a front perspective view of a portion of the fireplace shown in FIG. 1 with the outer enclosure removed.

The combustion air enclosure 18 is secured to the combustion chamber enclosure 14 along the front surface 96 of the combustion chamber enclosure 14 and the front surface 118 of the combustion air enclosure 18 such that only a single gasket or other sealing structure is required to form an airtight seal between the enclosures 14, 18. The combined combustion chamber enclosure 18 and combustion air wrap 18 form a firebox assembly 40, as shown in FIG. 8.

Combustion air enclosure 18 is also configured so as to provide a complete jacket or wrap around the entire outer surface of the combustion chamber enclosure 14 (except around the front surface 96), thus providing an extensive combustion air chamber 116 that facilitates free flow of combustion air all around the panels of the combustion chamber enclosure 14. As a result of this configuration, a hole extending through any panel of the combustion chamber enclosure 14 provides an opening for intake of combustion air into the combustion chamber enclosure. Thus, combustion air can be provided at very specific locations within the combustion chamber enclosure to meet the specific needs of a particular burner plate assembly design. Also, when using a plurality of combustion air inlet openings 88 throughout the combustion chamber enclosure 14, the fireplace is much less susceptible to environmental changes such as high gusts of wind that would otherwise extinguish the fire within the combustion chamber enclosure 14. Furthermore, the movement of combustion air around the outer surface of the combustion chamber enclosure 14 helps to cool the combustion chamber enclosure 14 and provide a further insulating layer between the combustion chamber and the outer enclosure 12.

In other embodiments, the combustion air enclosure may extend around two or more of the combustion chamber enclosure panels. For example, the combustion air enclosure may extend around only the bottom and first and second side panels of the combustion chamber enclosure, or around only the first and second side and rear panels of the combustion chamber enclosure. Further, although the combustion air enclosure shown in the Figures covers the entire outer surface of each of the panels of the combustion chamber enclosure, in other embodiments the combustion air enclosure may cover only portions of certain panels of the combustion chamber enclosure.

Figure 6:
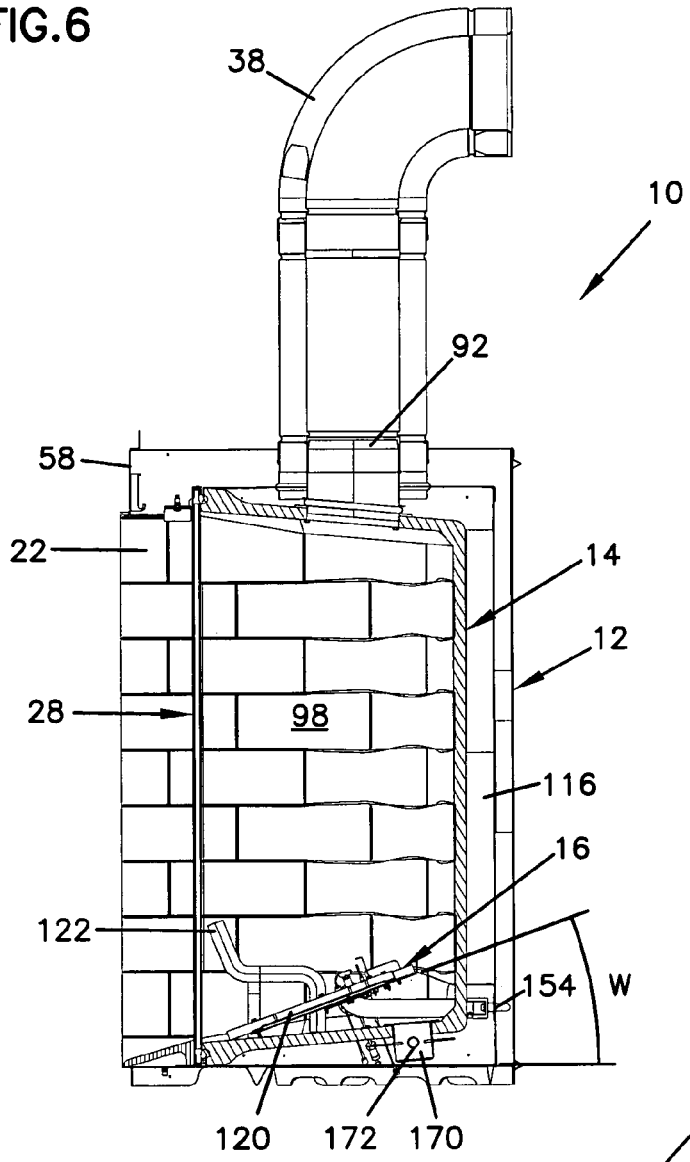
FIG. 6 is a cross-sectional view of the fireplace shown in FIG. 1 taken along cross-sectional indicators 6—6.

The burner plate assembly 16 includes a burner plate 120, a grate 122, mounting brackets 124, a pilot light 126 and a pilot light support 128. The mounting brackets 124 may extend through combustion air inlet openings 88 and be secured to the rear panel 100 of the combustion air enclosure 118 (see FIG. 7). The burner plate 120 may be made of a number of different materials including, for example, a ceramic material, metals or metal alloys. If the burner plate 120 is made from a ceramic material it may be advantageous to position the burner plate at an angle (as shown in FIG. 6) to help spread the flame across a top surface of the burner plate so as to enhance the look of the flame emanating from the burner plate. Positioning the burner plate 120 at an angle may also provide the advantage of raising a rear portion of an artificial set of logs sitting on grate 122 and burner plate 120 to provide a better view of the logs and the flames of the burner plate. Such an angled burner plate arrangement may be less advantageous for a metal or metal alloy burner because contact of the flame on the top surface of the burner plate may reduce the life of the burner plate.

The glass panel 28 includes a glass sheet 140 and a glass frame 142. Glass panel 28 is mounted to the combustion chamber enclosure 14 and combustion air enclosure 18 with the glass panel latches 112. Latches 112 each include a spring-biased connector that retains the glass panel against the front surface of combustion chamber enclosure 14. The use of spring-biased connectors may be particularly advantageous when unignited gas builds up in the combustion chamber enclosure 14 and then is ignited. The springs of the spring biased connectors would allow the glass panel to move away from the front surface of the combustion chamber enclosure to relieve the pressure resulting form the ignition of the built-up gas, thereby breaking the seal otherwise formed there between to permit the pressure from the ignited gas to exit the combustion chamber enclosure 14 rather than breaking the glass.

Typically, mounting glass panel 28 with glass panel latches 112 provides an airtight seal of the combustion chamber 98 and the combustion air chamber 116 with exception of the openings 92, 111 for exhausting and providing combustion air, respectively. Glass frame 142 may include a mounting bracket 144 that supports the hanging wire mesh 36, which wire mesh is common for protecting the user from harmful touching of the glass sheet 140 when the glass panel 28 is heated.

Figure 5:
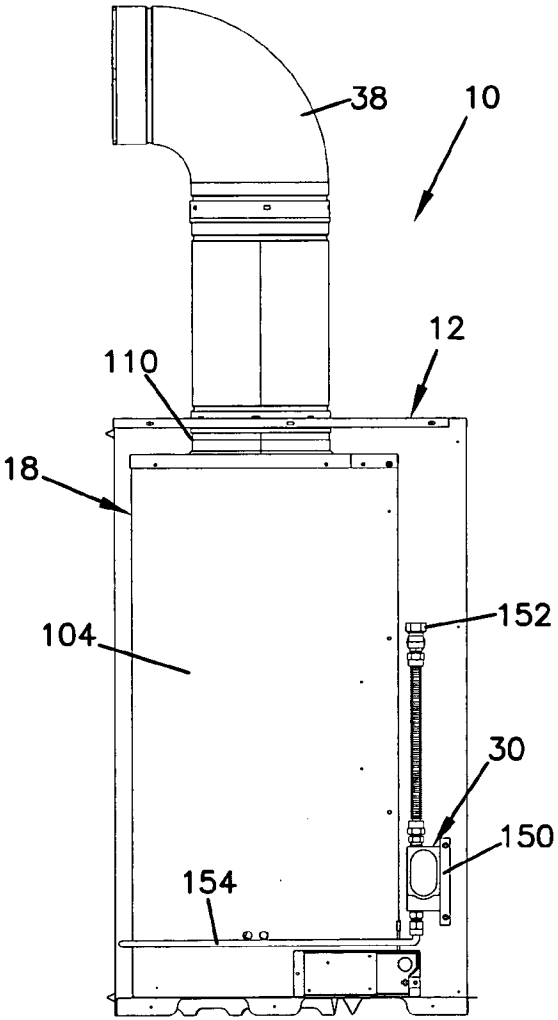
FIG. 5 is a side plan view of the fireplace shown in FIG. 1 with a side panel of the outer enclosure removed.
Figure 4:
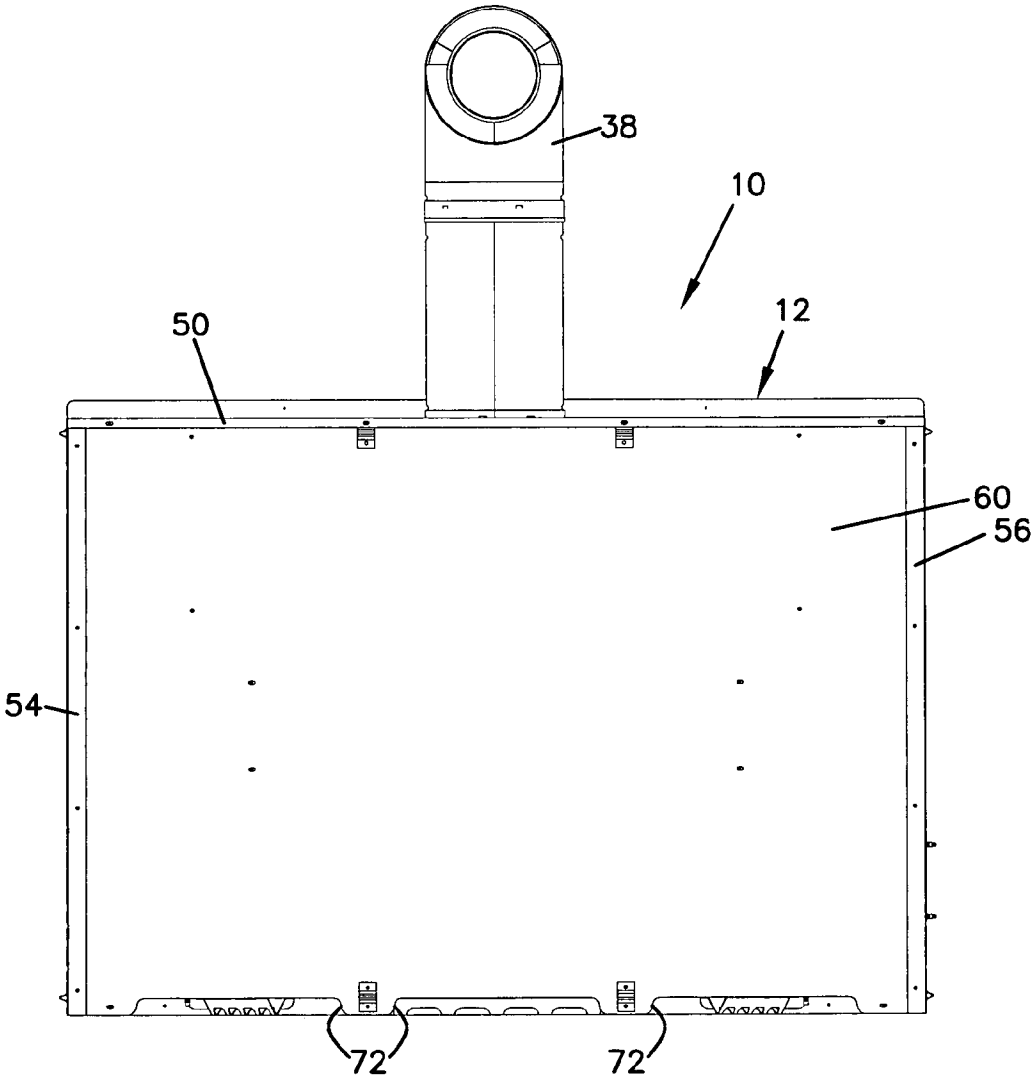
FIG. 4 is a rear plan view of the fireplace shown in FIG. 1.
Figure 7:
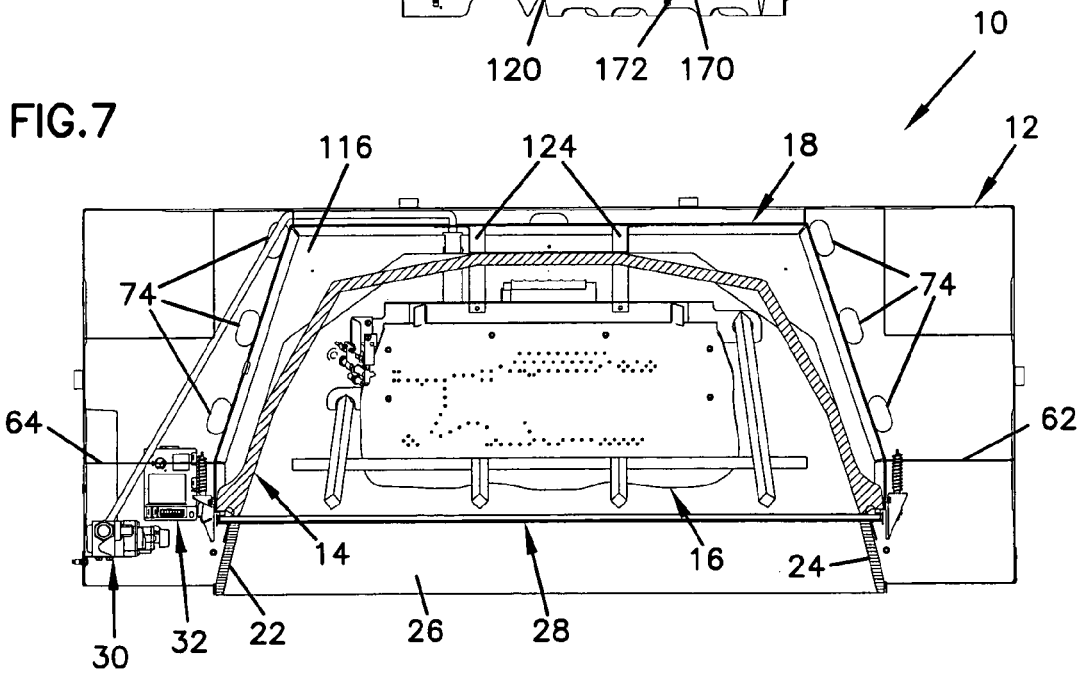
FIG. 7 is a cross-sectional view of the fireplace shown in FIG. 1 taken along cross-sectional indicators 7—7.

Referring now to FIGS. 5 and 7, the gas valve assembly 30 is shown mounted within outer enclosure 12. Gas valve assembly 30 includes a valve 150, a gas inlet supply 152, and a gas burner supply 154. As opposed the orientation of the gas valve assembly of most known fireplace assemblies, gas valve assembly 30 is positioned between the outer enclosure 12 and a side surface of continuous panel 84 of the combustion chamber enclosure 14, rather than beneath the bottom panel 82 of combustion chamber enclosure 14. When the assembled combustion chamber enclosure 14 and combustion air enclosure 18 are mounted within outer enclosure 12, there is a space provided between front surfaces 98, 118 of the combustion chamber enclosure 14 and combustion air enclosure 18 and the front panel 58 of the outer enclosure 12. This space provides an access space for the mounted gas valve assembly 30 as well as to the control unit assembly 32, which control assembly includes a control module 160, a wire harness 162 and electrical junction box 164. This access space may be covered by the first and second removable panels 20, 22 so as to hide the gas valve assembly 30 and control unit assembly 32 from view.

In other embodiments, some components of the gas valve assembly 30 and control unit assembly 32 may be positioned at other locations within outer enclosure 12 besides beneath the bottom panel 82 or between the continuous panel 84 and outer enclosure 12, or may be positioned outside the outer enclosure in relative close proximity to the fireplace assembly 10. In yet further embodiments, some components of the gas valve assembly and other fireplace controls may be positioned at remote locations, for example, in an adjacent room to where the fireplace assembly resides.

The valve assembly 30 and control unit assembly 32 may be generally referred to as "controls" for the fireplace assembly. Other example features of a fireplace assembly that may also be considered part of the fireplace controls are switches, dials, computer chips and microprocessors, sensors, wiring, and meters. These controls may be used to control accessories associated with the fireplace, such as, for example, lights, blowers (e.g., circulating fan), artificial displays, sounds, etc. In some embodiments, some or all of the fireplace controls may be positioned outside of the outer enclosure 12, or may be positioned under the firebox 40 either inside or outside of the outer enclosure 12.

Panels 20, 22 are removably mounted in place between glass panel 28 and front panel 58 of the outer enclosure 12, and include a brick design that corresponds to the brick design of continuous panel 84. Preferably, the design formed on panels 20, 22 will substantially match with whatever design is included within the combustion chamber enclosure 14 so as to give the appearance of a continuous side wall even though the glass panel 28 is positioned between the removable panels 20, 22 and continuous side panel 84 of the combustion chamber enclosure 14. The ash lip panel 26 is also removable and is configured to cover a lower portion of glass frame 142 such that glass frame 142 is substantially covered by panels 20, 22, 26. The removable nature of panels 20, 22, 26 is also advantageous for use with the spring biased glass panel latches 112, which permit the glass panel to move away from the combustion chamber enclosure. A further upper panel (not shown) may also be included in some embodiments to cover a top portion of glass frame 142.

The light assembly 34 includes a light box 170, a light bulb 172 and a color film 174 positioned within light source opening 90 in combustion chamber enclosure 14. Light from light bulb 172 is projected upward within combustion chamber 98 to enhance the light of the actual flame from burner plate assembly 16 with the combustion chamber 98, and provides additional shadowing within combustion chamber 98 along the brick design ledges 86. The light of light bulb 172 may be changed in color using a color film 174 that includes, for example, Kapton film or tape having an orange, yellow, or amber color. In other embodiments, light assembly 34 may include additional lights positioned at other locations around or adjacent to combustion chamber enclosure 14 so as to provide additional light within combustion chamber 98 as desired. Additional details related to a light source for use in a fireplace combustion chamber are disclosed in U.S. patent application Ser. No. 10/718,037, entitled "Backlighing System for a Fireplace", filed on the same date herewith, which application is incorporated herein by reference in its entirety.

A fireplace that includes features and advantages of the present invention may be formed using a method of manufacturing that includes forming an outer enclosure having a rear panel, a front panel that defines a front surface of the fireplace, a combustion chamber enclosure that includes at least a front surface and a side surface thereby defining a combustion chamber, a combustion air passage wrap, a glass panel, and fireplace controls. The method of manufacture may further include positioning the combustion chamber enclosure within the outer enclosure between the front and rear panels such that the front surface of the combustion chamber enclosure is spaced rearward from the front panel, securing the glass panel to the front surface of the combustion chamber enclosure, positioning the controls between the outer enclosure and the combustion chamber enclosure, and positioning the air passage wrap between the outer enclosure and the combustion chamber enclosure thereby forming a combustion air passage between the air passage wrap and the combustion chamber enclosure.

The present invention may also encompass a method of assembling a fireplace that includes a combustion chamber enclosure defining a combustion chamber, a combustion air enclosure, and a glass panel. The method may include positioning the combustion chamber enclosure within the combustion air enclosure and securing the glass panel to the combustion chamber enclosure with the combustion air enclosure positioned there between, thereby sealing the fireplace with an air-tight seal.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A heating appliance, comprising:

a combustion chamber enclosure having a front panel and defining a combustion chamber;

an outer enclosure having a front panel and defining an inner volume sized to receive the combustion chamber enclosure at a position wherein the front panel of the combustion chamber is spaced rearward of and arranged substantially parallel with the front panel of the outer enclosure;

an access panel extending in a direction substantially perpendicular to the front panel of the combustion chamber enclosure between the front panel of the combustion chamber enclosure and the front panel of the outer enclosure; and controls disposed within the inner volume of the outer enclosure outside of the combustion chamber enclosure.

2. The heating appliance of claim 1, further comprising a combustion air enclosure positioned in the inner volume of the outer enclosure between the combustion chamber enclosure and the outer enclosure and configured to provide combustion air to the combustion chamber through an aperture formed at any location in a side panel or a rear panel of the combustion chamber enclosure.

3. The heating appliance of claim 2, wherein combustion chamber enclosure includes at least top, bottom, rear, and first and second side panels, and the combustion air enclosure extends around substantially all of an outer surface of at least two panels of the combustion chamber enclosure.

4. The heating appliance of claim 2, wherein the combustion chamber enclosure includes top and bottom panels and a side panel extending between the top and bottom panels, and the combustion air enclosure extends around substantially all of the side panel of the combustion chamber enclosure.

5. The heating appliance of claim 2, wherein the controls are disposed within the inner volume of the outer enclosure outside of the combustion air enclosure.

6. The heating appliance of claim 1, wherein the outer enclosure and the combustion chamber enclosure each include a bottom panel, and the bottom panel of the combustion chamber enclosure is arranged substantially coplanar with a hearth member that extends in front of the heating appliance.

7. The heating appliance of claim 1, further comprising a glass panel positioned between the access panel and a front surface of the combustion chamber enclosure.

8. The heating appliance of claim 1, wherein the access panel includes first and second side members aligned substantially coplanar with side surfaces of the combustion chamber enclosure, and a bottom member aligned substantially coplanar with a bottom surface of the combustion chamber enclosure.

9. The heating appliance of claim 1, wherein the combustion chamber enclosure and the access panel include a matching brick pattern.

10. The heating appliance of claim 6, wherein the glass panel is retained to the combustion chamber enclosure with a spring biased member that permits movement of the glass panel away from the combustion chamber in response to high combustion forces within the combustion chamber.

11. The heating appliance of claim 1, wherein the controls are positioned between a side surface of the combustion chamber enclosure and the outer enclosure.

12. The heating appliance of claim 1, further comprising a light source configured to direct light into the combustion chamber.

13. The heating appliance of claim 1, wherein the combustion chamber enclosure includes first and second side panels and a rear panel, each of the rear and first and second side panels including a planar portion, and the intersection of the side and rear panels including a contoured surface to provide the appearance that the combustion chamber enclosure has substantially no back corners.

14. The heating appliance of claim 13, wherein the contoured surface includes an overlapping structure that provides a ledge structure.

15. The heating appliance of claim 1, wherein the combustion chamber enclosure is formed using compression or injection molding or vacuum forming.

16. The heating appliance of claim 8, the side panel of the combustion chamber enclosure includes air passage apertures formed therein to promote airflow between the combustion air chamber and the combustion chamber.

17. A method of manufacturing a heating appliance that includes an outer enclosure having a rear panel and a front panel that defines a front surface of the heating appliance, a combustion chamber enclosure having top, bottom and side panels defining a combustion chamber and a front surface of the combustion chamber enclosure, a combustion air enclosure, a glass panel, and controls, the method comprising the steps of:

positioning the combustion chamber enclosure within the outer enclosure between the front and rear panels such that the front surface of the combustion chamber enclosure is spaced rearward from the front panel of the outer enclosure;

coupling the glass panel to the front surface of the combustion chamber enclosure;

positioning the controls between the outer enclosure and one of the side panels of the combustion chamber enclosure;

positioning the combustion air enclosure between the outer enclosure and the combustion chamber enclosure thereby forming a combustion air chamber;

surrounding substantially all of the rear and side panels of the combustion chamber enclosure with the combustion air enclosure, wherein an aperture formed through any one of the rear and side panels of the combustion chamber provides a combustion air opening into the combustion chamber from the combustion air enclosure wherein the heating appliance further includes a removable panel; and positioning the removable panel between the front panel of the outer enclosure and the front surface of the combustion chamber enclosure and aligned in a direction substantially perpendicular to the front panel and vertically oriented along a side of the front panel.

18. The method of claim 17, wherein the removable panel substantially covers a metal frame of the glass panel from view.

19. The method of claim 17, further comprising forming a pattern in the panel that substantially matches a pattern formed in the combustion chamber enclosure.

20. A method of manufacturing a heating appliance that includes an outer enclosure having a rear panel and a front panel that defines a front surface of the heating appliance, a combustion chamber enclosure having top, bottom and side panels defining a combustion chamber and a front surface of the combustion chamber enclosure, a combustion air enclosure, a glass panel, and controls, the method comprising the steps of:

positioning the combustion chamber enclosure within the outer enclosure between the front and rear panels such that the front surface of the combustion chamber enclosure is spaced rearward from the front panel of the outer enclosure;

coupling the glass panel to the front surface of the combustion chamber enclosure;

positioning the controls between the outer enclosure and one of the side panels of the combustion chamber enclosure;

positioning the combustion air enclosure between the outer enclosure and the combustion chamber enclosure thereby forming a combustion air chamber;

surrounding substantially all of the rear and side panels of the combustion chamber enclosure with the combustion air enclosure, wherein an aperture formed through any one of the rear and side panels of the combustion chamber provides a combustion air opening into the combustion chamber from the combustion air enclosure, wherein the side panel of the combustion chamber enclosure extends along first and second side and rear portions of the combustion chamber enclosure; and forming the side panel of the combustion chamber enclosure such that each of the side and rear portions of the side panel includes a planar portion and the intersection of the side and rear portions of the side panel are contoured to provide an appearance that the combustion chamber has substantially no back corners.

21. A method of manufacturing a heating appliance that includes an outer enclosure having a rear panel and a front panel that defines a front surface of the heating appliance, a combustion chamber enclosure having top, bottom and side panels defining a combustion chamber and a front surface of the combustion chamber enclosure, a combustion air enclosure, a glass a panel, and controls, wherein the side panel includes an intersecting first side panel and a back panel, the method comprising the steps of:

positioning the combustion chamber enclosure within the outer enclosure between the front and rear panels such that the front surface of the combustion chamber enclosure is spaced rearward from the front panel of the outer enclosure;

coupling the glass panel to the front surface of the combustion chamber enclosure;

positioning the controls between the outer enclosure and one of the side panels of the combustion chamber enclosure;

positioning the combustion air enclosure between the outer enclosure and the combustion chamber enclosure thereby forming a combustion air chamber;

surrounding substantially all of the rear and side panels of the combustion chamber enclosure with the combustion air enclosure, wherein an aperture formed through any one of the rear and side panels of the combustion chamber provides a combustion air opening into the combustion chamber from the combustion air enclosure;

molding a brick design in the combustion chamber enclosure; and forming a contoured surface in the brick design at an intersection of the first side and back panels, wherein the contoured surface includes an overlapping brick arrangement that provides a shelf feature.

22. A fireplace assembly, comprising:

a combustion chamber enclosure defining a combustion chamber, the combustion chamber enclosure including first and second side panels and a rear panel, and the intersection of the side and rear panels includes a contoured surface to provide the appearance that the combustion chamber enclosure has substantially no back corners, the contoured surface including an overlapping structure that provides a ledge structure;

an outer enclosure having a front panel and defining an inner volume sized to receive the combustion chamber enclosure at a position spaced rearward from the front panel;

an access panel positioned between the combustion chamber enclosure and the front panel of the outer enclosure; and fireplace controls disposed within the inner volume of the outer enclosure outside of the combustion chamber enclosure.

* * * * *

UNITED STATES PATENT AND TRADEMARK OFFICE

CERTIFICATE OF CORRECTION

PATENT NO. : 7,077,122 B2
APPLICATION NO. : 10/718053
DATED : July 18, 2006
INVENTOR(S) : David Charles Lyons et al.

It is certified that error appears in the above-identified patent and that said Letters Patent is hereby corrected as shown below:

Column 12

Line 7, delete "a" in between glass and panel -- glass panel --

Signed and Sealed this

Twenty-sixth Day of December, 2006

JON W. DUDAS
*Director of the United States Patent and Trademark Office*